US006803177B2

(12) United States Patent
Bokhonov et al.

(10) Patent No.: US 6,803,177 B2
(45) Date of Patent: Oct. 12, 2004

(54) SILVER COMPOUNDS AND COMPOSITIONS, THERMALLY DEVELOPABLE MATERIALS CONTAINING SAME, AND METHODS OF PREPARATION

(75) Inventors: Boris B. Bokhonov, Novosibirsk (RU); Lilia P. Burleva, Maplewood, MN (US); David R. Whitcomb, Woodbury, MN (US); Nepal C. Howlader, Woodbury, MN (US); Louis M. Leichter, Mendota Heights, MN (US)

(73) Assignee: Eastman Kodak Company, Rochester, NY (US)

( * ) Notice: Subject to any disclaimer, the term of this patent is extended or adjusted under 35 U.S.C. 154(b) by 63 days.

(21) Appl. No.: 10/208,603

(22) Filed: Jul. 30, 2002

(65) Prior Publication Data

US 2004/0023164 A1 Feb. 5, 2004

(51) Int. Cl.[7] ..... G03C 1/498

(52) U.S. Cl. ..... 430/350; 430/223; 430/230; 430/567; 430/619; 430/620

(58) Field of Search ..... 430/619, 567, 430/620, 350, 223, 230

(56) References Cited

U.S. PATENT DOCUMENTS

| | | | | |
|---|---|---|---|---|
| 3,457,075 A | | 7/1969 | Morgan et al. | |
| 3,839,049 A | | 10/1974 | Simons | |
| 5,382,504 A | | 1/1995 | Shor et al. | |
| 5,677,121 A | | 10/1997 | Tsuzuki | |
| 5,705,324 A | * | 1/1998 | Murray | 430/350 |
| 6,211,116 B1 | | 4/2001 | Defieuw et al. | |
| 6,391,537 B2 | | 5/2002 | Lelental et al. | |

FOREIGN PATENT DOCUMENTS

| | | |
|---|---|---|
| EP | 0 962 814 A1 | 12/1999 |
| EP | 0 962 815 A1 | 12/1999 |
| EP | 0 964 300 A1 | 12/1999 |
| EP | 1 168 069 A1 | 1/2002 |

OTHER PUBLICATIONS

B.B. Bokhonov et al., *Silver Halide/Silver Carboxylate Photothermographic Imaging Systems: Characteristic Properties of Structure and Development*, pp. 38–41 50$^{th}$ IS&T Conference, Boston, MA 1997.

V.M. Belous et al., *Chemical Sensitization of Internal Light Sensitive Photographic Emulsions with Heterophase MicrocrystalsI*, Zhur. Nauch. I Priklad. Fotogr. I Kinematogr., 36, 1991, 416.

(Translation) V.M. Belous et al., *Chemical Sensitization of Internal Light Sensitive Photographic Emulsions with Heterophase MicrocrystalsI*, Zhur. Nauch. I Priklad. Fotogr. I Kinematogr., 36, 1991, 416.

* cited by examiner

*Primary Examiner*—Thor Chea
(74) *Attorney, Agent, or Firm*—J. Lanny Tucker; Louis M. Leichter

(57) ABSTRACT

Novel silver compounds can include a primary core of a photosensitive silver halide and a shell covering the primary core. This shell includes one or more non-photosensitive silver salts, each silver salt including an organic silver coordinating ligand. Other novel silver compounds are homogeneous silver salts of organic silver coordinating ligands throughout (non-core-shell). Still other silver compounds can include a primary core of a non-photosensitive metal salt and a shell covering the primary core. This shell includes one or more non-photosensitive silver salts, each silver salt including an organic silver coordinating ligand. These types of silver compounds can be used as sources of reducible silver ions in thermally developable imaging materials including thermographic and photothermographic materials.

19 Claims, No Drawings

SILVER COMPOUNDS AND COMPOSITIONS, THERMALLY DEVELOPABLE MATERIALS CONTAINING SAME, AND METHODS OF PREPARATION

FIELD OF THE INVENTION

This invention relates to novel silver compounds that can be used as a source of reducible silver ions in thermally developable imaging materials. The invention also includes imaging compositions and methods of making the silver compounds. In particular, the invention relates to thermographic and photothermographic materials containing these silver compounds.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing thermographic imaging materials are non-photosensitive materials that are used in a recording process wherein images are generated by the use of thermal energy. These materials generally comprise a support having disposed thereon (a) a relatively or completely non-photosensitive source of reducible silver ions, (b) a reducing composition (usually including a developer) for the reducible silver ions, and (c) a suitable hydrophilic or hydrophobic binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, silver behenate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such, an anti-stick layer is coated on top of the imaging layer to prevent sticking of the thermographic construction to the thermal head of the apparatus utilized. The resulting thermographic construction is then heated to an elevated temperature, typically in the range of from about 60 to about 225° C. resulting in the formation of an image.

Silver-containing photothermographic imaging materials are photosensitive materials that are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998, pp.67–70).

The silver halide may also be "preformed" and prepared by an "ex-situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids." Silver salts of other organic acids or other organic compounds, such as silver imidazoles, silver tetrazoles, silver benzotriazoles, silver benzotetrazoles, silver benzothiazoles, and silver acetylides may also be used. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

While a number of useful thermographic and photothermographic materials are available in the market and described in the art for medical and graphic arts use, there is a continuing need for improving the reactivity of the imaging composition in such materials to provide reducible silver ions. In particular, there is a need for imaging materials that utilize non-photosensitive silver compounds that can be imaged and/or developed at lower temperatures while providing high $D_{max}$, good image tone, quality, and stability.

SUMMARY OF THE INVENTION

The present invention provides a core-shell silver compound comprising a primary core comprising one or more photosensitive silver halides, and a shell at least partially covering the primary core, wherein the shell comprises one or more non-photosensitive silver salts, each of which silver salts comprises a organic silver coordinating ligand.

This invention also provides a composition comprising:

a) a core-shell silver compound comprising a primary core comprising one or more photosensitive silver halides, and a shell at least partially covering the primary core, wherein the shell comprises one or more non-photosensitive silver salts, each of which silver salts comprises an organic silver coordinating ligand, and b) a non-photosensitive non-core-shell silver salt.

In another embodiment, this invention provides a composition comprising:

a) a first core-shell silver compound comprising a first primary core comprising one or more photosensitive silver halides, and a first shell at least partially covering the first primary core, wherein the first shell comprises one or more non-photosensitive silver salts, each of which silver salts comprises an organic silver coordinating ligand, and b) a second core-shell silver compound comprising a second primary core comprising one or more photosensitive silver halides, and a second shell at least partially covering the second primary core, wherein the second shell comprises one or more non-photosensitive silver salts, each of which silver salts comprises an organic silver coordinating ligand, the first and second core-shell silver compounds differing in composition in either their primary cores and/or shells.

In one embodiment, the composition further comprises a binder. In another embodiment, the composition comprises a reducing agent composition for reducible silver ions. In yet another embodiment, the composition further comprises a photocatalyst. A preferred photocatalyst is a photosensitive silver halide.

Further, a thermally developable emulsion comprises:

a) a source of non-photosensitive silver ions comprising a core-shell silver compound comprising a primary core comprising one or more photosensitive silver halides, and a shell at least partially covering the primary core, wherein the shell comprises one or more non-photosensitive silver salts, each of which silver salts comprises an organic silver coordinating ligand, b) a reducing composition for the non-photosensitive silver ions, and c) a binder.

In one embodiment, the thermally developable emulsion further comprises a photocatalyst. A preferred photocatalyst is a photosensitive silver halide.

In addition, a thermally developable imaging material comprises a support having thereon one or more imaging layers comprising:

a) a source of non-photosensitive silver ions comprising a core-shell silver compound comprising a primary core comprising one or more photosensitive silver halides, and a shell at least partially covering the primary core, wherein the shell comprises one or more non-photosensitive silver salts, each of which silver salts comprises an organic silver coordinating ligand, b) a reducing composition for the non-photosensitive silver ions, and c) a binder.

In a preferred embodiment, this invention provides a photothermographic material comprising a support having thereon one or more layers comprising:

a) a source of non-photosensitive silver ions comprising a core-shell silver compound comprising a primary core comprising one or more photosensitive silver halides, and a shell at least partially covering the primary core, wherein the shell comprises one or more non-photosensitive silver salts, each of which silver salts comprises an organic silver coordinating ligand, b) a reducing composition for the non-photosensitive silver ions, c) a binder, and d) a photocatalyst.

This invention also provides a method of making the core-shell silver compounds described above, the method comprising mixing a core-shell photosensitive silver halide with one or more ammonium or alkali metal salts of organic silver coordinating ligands for sufficient time to form the core-shell silver compound. comprising a primary core comprising one or more photosensitive silver halides, and a shell at least partially covering the primary core, wherein the shell comprises one or more non-photosensitive silver salts comprised of one or more organic silver coordinating ligands.

The present invention also provides a core-shell silver compound comprising a primary core comprising one or more non-photosensitive inorganic metal salts or non-silver-containing organic salts, and a shell at least partially covering the primary core, wherein the shell comprises one or more non-photosensitive silver salts, each of which silver salts comprises an organic silver coordinating ligand.

This invention also provides a composition comprising:

a) a core-shell silver compound comprising a primary core comprising one or more non-photosensitive inorganic metal salts or non-silver-containing organic salts, and a shell at least partially covering the primary core, wherein the shell comprises one or more non-photosensitive silver salts, each of which silver salts comprises an organic silver coordinating ligand, and b) a non-photosensitive non-core-shell silver salt.

In another embodiment, this invention provides a composition comprising:

a) a first core-shell silver compound comprising a first primary core comprising one or more non-photosensitive inorganic metal salts or non-silver-containing organic salts, and a first shell at least partially covering the first primary core, wherein the first shell comprises one or more non-photosensitive silver salts, each of which silver salts comprises an organic silver coordinating ligand, and b) a second core-shell silver compound comprising a second primary core comprising one or more non-photosensitive inorganic metal salts or non-silver-containing organic salts, and a second shell at least partially covering the second primary core, wherein the second shell comprises one or more non-photosensitive silver salts, each of which silver salts comprises an organic silver coordinating ligand, the first and second core-shell silver compounds differing in composition in either their primary cores and/or shells.

In one embodiment, the composition further comprises a photocatalyst. A preferred photocatalyst is a photosensitive silver halide.

Further, this invention also provides a thermally developable emulsion comprising:

a) a source of non-photosensitive silver ions comprising a core-shell silver compound comprising a primary core comprising one or more non-photosensitive inorganic metal salts or non-silver-containing organic salts, and a shell at least partially covering the primary core, wherein the shell comprises one or more non-photosensitive silver salts, each of which non-photosensitive silver salts comprises an organic silver coordinating ligand, b) a reducing composition for the non-photosensitive silver ions, and c) a binder.

In addition, a thermally developable imaging material comprises a support having thereon one or more imaging layers comprising:

a) a source of non-photosensitive silver ions comprising a core-shell silver compound comprising a primary core comprising one or more non-photosensitive inorganic metal salts or non-silver-containing organic salts, and a shell at least partially covering the primary core, wherein the shell comprises one or more non-photosensitive silver salts, each of which non-photosensitive silver salts comprises an organic silver coordinating ligand, b) a reducing composition for the non-photosensitive silver ions, and c) a binder.

This invention also provides a method of making core-shell silver compounds, the method comprising:

mixing a core-shell non-photosensitive metal salt comprising a primary core comprising one or more non-photosensitive inorganic metal salts or non-silver-containing organic salts, and a shell at least partially covering the primary core, wherein the shell comprises one or more non-photosensitive silver salts, with one or more ammonium or alkali metal salts of organic silver coordinating ligands for sufficient time to form a core-shell silver compound comprising a primary core comprising one or more non-photosensitive metal salts, and a shell at least partially covering said primary core, which shell comprises one or more non-photosensitive silver salts comprised of said one or more organic silver coordinating ligands.

Also provided by this invention is a surfactant-free composition comprising a non-photosensitive organic silver salt comprising an organic coordinating ligand, the organic silver salt having an average particle size of less than or equal to 0.5 $\mu$m.

A thermally developable composition comprises:

a) the surfactant-free composition noted above containing a non-photosensitive organic silver salt having an average particle size of less than or equal to 0.5 $\mu$m, and b) a reducing agent for the non-photosensitive silver salt.

In addition, a thermally developable imaging material comprises a support having thereon one or more imaging layers comprising:

a) the surfactant-free composition noted above containing a non-photosensitive organic silver salt having an average particle size of less than or equal to 0.5 $\mu$m, b) a reducing composition for the non-photosensitive silver ions, and c) a binder.

Further, a photothermographic material comprises a support having thereon one or more layers comprising:

a) the surfactant-free composition noted above containing a non-photosensitive organic silver salt having an average particle size of less than or equal to 0.5 $\mu$m, b) a reducing composition for the non-photosensitive silver ions, c) a binder, and d) a photocatalyst.

This invention also provides a method of making the non-photosensitive organic silver salts described above, the method comprising mixing a non-photosensitive silver halide with one or more ammonium or alkali metal salts of an organic silver coordinating ligand for a sufficient time to form the organic silver salt. This method can be used to prepare the non-photosensitive organic silver salts having an average particle size of less than or equal to 0.5 $\mu$m, described above.

The present invention further provides organic silver compounds comprising one or more non-photosensitive silver salts, each of which silver salts comprises an organic silver coordinating ligand, the organic silver compound formed by reaction of a silver halide with one or more ammonium or alkali metal salts of an organic silver coordinating ligand for a sufficient time to form the organic silver compound.

In another embodiment, the present invention provides a method comprising imagewise exposing the thermally developable material of this invention to thermal energy to form a visible image.

In another embodiment, the present invention provides a method comprising:

A) imagewise exposing the photothermographic material of this invention to electromagnetic radiation to which the photocatalyst (for example, a photosensitive silver halide) of the material is sensitive, to form a latent image, and B) simultaneously or sequentially, heating the exposed material to develop the latent image into a visible image.

Thermographic and photothermographic materials incorporating both the novel core-shell silver compounds and the novel non-core-shell compounds of this invention as the non-photosensitive source of reducible silver ions can provide images with desired image stability, $D_{max}$, and tone. They can be imaged and/or developed at lower temperatures.

The novel core-shell silver compounds of this invention are prepared using a novel and simple method whereby core-shell photosensitive silver halide grains are mixed with a salt comprising an organic silver coordinating ligand (such as a carboxylate or a benzotriazolate). The organic silver coordinating ligand reacts with the silver in the "shell" portion of the silver halide grains to provide a "shell" of non-photosensitive silver salt around the unreacted core of silver halide. The novel core-shell silver compounds so formed have different reactivity and crystal morphology from core-shell silver compounds prepared by previously used methods.

Similarly, the novel non-core-shell silver compounds of this invention are also prepared using a novel and simple method whereby non-photosensitive silver halide grains are mixed with a salt comprising an organic silver coordinating ligand (such as a carboxylate or a triazolate). The organic silver coordinating ligand replaces the halide in the silver halide grains to provide a non-photosensitive silver salt. The novel non-core-shell silver compounds so formed have different reactivity and crystal morphology from core-shell silver compounds prepared by previously used methods.

Additionally, the novel core-shell silver compounds of this invention are prepared using a novel and simple method whereby non-photosensitive metal salt grains are mixed with a salt comprising an organic silver coordinating ligand (such as a carboxylate or a triazolate). The organic silver coordinating ligand replaces the anion of the metal salt to provide a non-photosensitive silver salt. The novel -core-shell silver compounds so formed have different reactivity and crystal morphology from core-shell silver compounds prepared by previously used methods.

The invention provides a means for providing predetermined organic silver salts with varying reactivity and unique imaging properties, particularly at the core-shell interface. Thus, thermally imageable materials can be prepared having specific predetermined properties.

DETAILED DESCRIPTION OF THE INVENTION

The thermally developable materials of this invention include both thermographic and photothermographic materials. While the following discussion will often be directed primarily to the preferred photothermographic embodiments, it would be readily understood by one skilled in the imaging arts that thermographic materials can be similarly constructed (using one or more imaging layers) and used to provide black-and-white or color images using the non-photosensitive core-shell silver compounds of this invention, reducing compositions, binders, and other components known to be useful in such embodiments.

The thermographic and photothermographic materials of this invention can be used in black-and-white or color thermography and photothermography and in electronically generated black-and-white or color hardcopy recording. They can be used in microfilm applications, in radiographic imaging (for example digital medical imaging), X-ray radiography, and in industrial radiography. Furthermore, the absorbance of these photothermographic materials between 350 and 450 nm is desirably low (less than 0.5), to permit their use in the graphic arts area (for example, imagesetting and phototypesetting), in the manufacture of printing plates, in contact printing, in duplicating ("duping"), and in proofing. The thermographic and photothermographic materials of this invention are particularly useful for medical, dental, and veterinary radiography to provide black-and-white images.

The photothermographic materials of this invention can be made sensitive to radiation of any suitable wavelength. Thus, in some embodiments, the materials are sensitive at ultraviolet, visible, infrared, or near infrared wavelengths of the electromagnetic spectrum. In other embodiments they are sensitive to X-radiation.

The materials of this invention are also useful for non-medical uses of visible or X-radiation (such as X-ray lithography and industrial radiography). In such imaging applications, it is sometimes useful that the photothermographic materials be "double-sided."

In the photothermographic materials of this invention, the components needed for imaging can be in one or more layers. The layer(s) that contain the photosensitive photocatalyst (such as a photosensitive silver halide in photothermographic materials) or the non-photosensitive core-shell silver compounds, or both, are referred to herein as photothermographic emulsion layer(s). The photocatalyst and the non-photosensitive core-shell silver compounds are in catalytic proximity (that is, in reactive association with each other) and preferably are in the same emulsion layer.

Similarly, in the thermographic materials of this invention, the components needed for imaging can be in one or more layers. The layer(s) that contain the non-photosensitive core-shell silver compounds are referred to herein as thermographic emulsion layer(s).

Where the materials contain imaging layers on one side of the support only, various non-imaging layers are usually disposed on the "backside" (non-emulsion or non-imaging side) of the materials, including antihalation layer(s), protective layers, antistatic layers, conducting layers, and transport enabling layers.

In such instances, various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

In some applications it may be useful that the photothermographic materials be "double-sided" and have thermally developable coatings on both sides of the support. In such constructions each side can also include one or more protective topcoat layers, primer layers, interlayers, antistatic layers, acutance layers, auxiliary layers, anti-crossover layers, and other layers readily apparent to one skilled in the art.

When the thermographic and photothermographic materials of this invention are heat-developed as described below in a substantially water-free condition after, or simultaneously with, imagewise exposure, a silver image (preferably a black-and-white silver image) is obtained.

Definitions

As used herein:

In the descriptions of the photothermographic materials of the present invention, "a" or "an" component refers to "at least one" of that component. Thus, the core-shell silver compounds of this invention can be used individually or in mixtures.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of layers wherein the photocatalyst (such as silver halide), and the source of reducible silver ions are in one layer and the other essential components or desirable additives are distributed, as desired, in an adjacent coating layer, as well as any supports, topcoat layers, image-receiving layers, blocking layers, antihalation layers, subbing, or priming layers. These materials also include multilayer constructions in which one or more imaging components are in different layers, but are in "reactive association" so that they readily come into contact with each other during imaging and/or development. For example, one layer can include the non-photosensitive core-shell silver compounds and another layer can include the reducing composition, but the two reactive components are in reactive association with each other.

"Thermographic material(s)" are similarly defined except that no photocatalyst is present.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads.

"Catalytic proximity" or "reactive association" means that the materials are in the same layer or in adjacent layers so that they readily come into contact with each other during thermal imaging and development.

"Emulsion layer," "imaging layer," "thermographic emulsion layer," or "photothermographic emulsion layer" means a layer of a thermographic or photothermographic material that contains the photosensitive silver halide (when used) and/or non-photosensitive core-shell silver compounds. It can also mean a layer of the thermographic or photothermographic material that contains, in addition to the photosensitive silver halide (when used) and/or non-photosensitive core-shell silver compounds, additional essential components and/or desirable additives. These layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed," "speed," or "photographic speed" (also known as sensitivity), absorbance, contrast, $D_{min}$, and $D_{max}$ have conventional definitions known in the imaging arts. In photothermographic materials, $D_{min}$ is considered herein as image density achieved when the photothermographic material is thermally developed without prior exposure to radiation. In thermographic materials, $D_{min}$ is considered herein as image density in the non-thermally imaged areas of the thermographic material. It is the average of eight lowest density values on the exposed side of the fiducial mark.

The sensitometric term "absorbance" is another term for optical density (OD).

"Transparent" means capable of transmitting visible light or imaging radiation without appreciable scattering or absorption.

As used herein, the phrase "organic silver coordinating ligand" refers to an organic molecule capable of forming a bond with a silver atom. Although the compounds so formed are technically silver coordination compounds they are also often referred to as silver salts.

The terms "double-sided" and "double-faced coating" are used to define photothermographic materials having one or more of the same or different thermally developable emulsion layers disposed on both sides (front and back) of the support.

In the compounds described herein, no particular double bond geometry (for example, cis or trans) is intended by the structures drawn. Similarly, the alternating single and double bonds and localized charges are drawn as a formalism. In reality, both electron and charge delocalization exists throughout the conjugated chain.

As is well understood in this art, for the chemical compounds described herein, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3$—$CH_2$—$CH_2$—O—$CH_2$— and $CH_3$—$CH_2$—$CH_2$—S—$CH_2$—), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide generally having up to 10 mole % silver iodide. Silver bromide is most preferred. Typical techniques for preparing and precipitating silver halide grains are described in *Research Disclosure,* 1978, item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions.

It is more preferable to form the source of reducible silver ions as a shell on the surface of ex-situ-prepared silver halide. In this process, the source of reducible silver ions, such as a long chain fatty acid silver carboxylate (commonly referred to as a silver "soap"), is formed by exchange of some of the halide ion of the preformed silver halide grains by an organic silver coordinating ligand. Formation of the reducible source of silver ions as a shell on the surface of the silver halide provides a more intimate mixture of the two materials. Materials of this type are often referred to herein as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It may also be effective to use an in-situ process in which a halide-containing compound is added to the organic silver salts of this invention to partially convert the silver of the organic silver salt to silver halide. The halogen-containing compound can be inorganic (such as zinc bromide or lithium bromide) or organic (such as N-bromosuccinimide).

Mixtures of both preformed and in-situ generated silver halide may also be used if desired.

In some instances, it may be helpful to prepare the photosensitive silver halide grains in the presence of a hydroxytetrazaindene (such as 4-hydroxy-6-methyl-1,3,3a,7-tetrazaindene or an N-heterocyclic compound comprising at least one mercapto group (such as 1-phenyl-5-mercaptotetrazole) to provide increased photospeed. Details of this procedure are provided in U.S. Pat. No. 6,413,710 (Shor et al.), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

The photosensitive silver halides used in the photothermographic emulsions and materials of the invention may be may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y. 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP 0 915 371 A (Lok et al.).

In addition, mercaptotetrazoles and tetraazindenes as described in U.S. Pat. No. 5,691,127 (Daubendiek et al.), incorporated herein by reference, can be used as suitable addenda for tabular silver halide grains.

When used, sulfur sensitization is usually performed by adding a sulfur sensitizer and stirring the emulsion at an appropriate temperature predetermined time. Examples of sulfur sensitizers include compounds such as thiosulfates, thioureas, thiazoles, rhodanines, thiosulfates and thioureas. In one preferred embodiment, chemical sensitization is achieved by oxidative decomposition of a sulfur-containing spectral sensitizing dye in the presence of a photothermographic emulsion. Such sensitization is described in U.S. Pat. No. 5,891,615 (Winslow et al.), incorporated herein by reference.

In another embodiment, certain substituted and unsubstituted thiourea compounds can be used as chemical sensitizers. Particularly useful tetra-substituted thioureas are described in U.S. Pat. No. 6,368,779 (Lynch et al.), that is incorporated herein by reference.

Other useful chemical sensitizers include certain tellurium-containing compounds that are described in U.S. Pat. No. 6,699,647 (Lynch et al.), that is incorporated herein by reference.

Combinations of gold (3+)-containing compounds and either sulfur- or tellurium-containing compounds are also useful as chemical sensitizers as described in U.S. Pat. No. 6,423,481 (Simpson et al.), that is also incorporated herein by reference.

Still other useful chemical sensitizers include certain selenium-containing compounds that are described in U.S. Pat. No. 6,620,577 (Lynch et al.), that is also incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 $\mu$m. The upper limit can vary depending upon the compound(s) used, the level of silver halide and the average grain size, and would be readily determinable by one of ordinary skill in the art.

Spectral Sensitizers

The photosensitive silver halides may be spectrally sensitized with various spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes are particularly useful. The cyanine dyes preferably include benzothiazole, benzoxazole, and benzoselenazole dyes that include one or more thioalkyl, thioaryl, or thioether groups. Suitable visible sensitizing dyes such as those described in U.S. Pat. No. 3,719,495 (Lea), U.S. Pat. No. 4,439,520 (Kofron et al.), and U.S. Pat. No. 5,281,515 (Delprato et al.) are effective in the practice of the invention. Suitable infrared sensitizing dyes such as those described in U.S. Pat. No. 5,393,654 (Burrows et al.), U.S. Pat. No. 5,441,866 (Miller et al.) and U.S. Pat. No. 5,541,054 (Miller et al.) are also effective in the practice of this invention. A summary of generally useful spectral sensitizing dyes is contained in *Research Disclosure*, item 308119, Section IV, December 1989. Additional classes of dyes useful for spectral sensitization, including sensitization at other wavelengths are described in *Research Disclosure,* 1994, item 36544, section V. All of the references and patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

In some embodiments, the non-photosensitive source of reducible silver ions used in thermographic and photothermographic materials of this invention includes at least one of the core-shell silver compounds of this invention. These compounds have a shell that provides reducible silver (1+) ions in thermal imaging reactions. Thus, the silver compounds have a shell that includes a silver salt of an organic silver coordinating ligand that is comparatively stable to light and forms a silver image when heated to 50° C. or higher in the presence of an exposed photocatalyst (such as silver halide, when used in a photothermographic material) and a reducing composition.

There is no particular limitation on the composition of the primary core or the shell of the compounds having a core and shell except that the primary core is composed of one or more photosensitive halides (as described above) and the shell is composed of one or more non-photosensitive silver salts. Preferably, the primary core is composed of silver bromide or silver iodobromide. In other embodiments, the primary core can be composed of a silver chlorobromide.

It is also possible that the primary core is composed of an inner region comprising a first photosensitive silver halide (or mixtures thereof) and an outer region comprising a different photosensitive silver halide or mixtures thereof. For example, the inner region of the primary core can be composed of predominantly silver bromide (that is, at least 50 mole % silver bromide). Useful inner regions of the primary core are the core-shell silver halide grains described in U.S. Pat. No. 5,382,504 (Shor et al.), U.S. Pat. No. 5,434,043 (Zou et al.), and U.S. Pat. No. 5,939,249 (Zou), noted above.

There is no practical limitation on the size of the outer region, so long as it has a surface capable of exchange with a silver coordinating ligand. Silver chloride is a preferred silver halide for the outer region. For example, the outer region can be composed of predominantly silver chloride (that is, at least 50 mole % silver chloride). In such embodiments, the ratio of the inner region to the outer region is from about 100:1 to about 1:100 and is preferably from about 75:1 to about 1:10.

The silver salts in the shell can be any of those conventional organic silver salts comprised of one or more organic silver coordinating ligands as described below in this section of the disclosure.

The transition between the shell and the core of the core-shell silver compounds may be abrupt so as to provide a distinct boundary, or diffuse so as to create a gradual transition from one non-photosensitive silver salt to another. In addition, there may be bands of different silver salts around what may be called the "primary" core of photosensitive silver halide. Thus, the primary core can be surrounded by two or more bands of different silver salts forming secondary cores or annular bands including the outermost shell.

The core-shell silver compound generally comprises a molar ratio of the one or more non-photosensitive silver salts in said shell to said one or more silver halides in the primary core of from about 100:1 to about 1:100.

In some embodiments, the outermost shell of the core-shell silver compound comprises a mixture of silver salts comprising different organic silver coordinating ligands. Such ligands are described in detail below in reference to various useful organic silver salts and are well known in the art. In preferred embodiments, these organic silver coordinating ligands comprise one or more carboxylates such as long chain aliphatic carboxylates, as described below.

Preferred organic silver coordinating ligands include long-chain aliphatic and aromatic carboxylic acids. The chains typically contain 10 to 30, and preferably 15 to 28, carbon atoms. Examples of silver salts of aliphatic carboxylic acids include silver behenate, silver arachidate, silver stearate, silver oleate, silver laurate, silver caproate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other aliphatic carboxylates.

Representative examples of the silver salts of aromatic carboxylic acid and other carboxylic acid group-containing compounds include, but are not limited to, silver benzoates, a silver substituted-benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the α-(on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of dicarboxylic acids are also useful. Such acids may be aliphatic, aromatic, or heterocyclic. Examples of such acids include, for example, phthalic acid, glutamic acid, or homo-phthalic acid.

Sulfonates are also useful coordinating ligands in the practice of this invention. Silver salts of such materials are described for example in U.S. Pat. No. 4,504,575 (Lee). Silver salts of sulfosuccinates are also useful as described for example in EP 0 227 141 A (Leenders et al.).

Compounds containing mercapto or thione groups and derivatives thereof can also be used as coordinating ligands. Preferred examples of these silver salts include, but are not limited to, a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,785,830 (Sullivan et al.)].

Examples of other useful silver salts of mercapto or thione substituted compounds that do not contain a heterocyclic nucleus include but are not limited to, a silver salt of thioglycolic acids such as a silver salt of an S-alkylthioglycolic acid (wherein the alkyl group has from 12 to 22 carbon atoms), a silver salt of a dithiocarboxylic acid such as a silver salt of a dithioacetic acid, and a silver salt of a thioamide.

In some embodiments, a compound containing an imino group as a coordinating ligand is preferred, especially in aqueous-based imaging formulations. Preferred examples of silver salts of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of benzotriazole is preferred in aqueous-based thermographic and photothermographic formulations.

Moreover, acetylides can be used as coordinating ligands, and silver salts of acetylenes can also be used as described, for example in U.S. Pat. No. 4,761,361 (Ozaki et al.) and U.S. Pat. No. 4,775,613 (Hirai et al.).

The core-shell silver compounds of this invention generally have an average particle size of from about 50 nm to about 10 μm, and preferably of from about 50 nm to about 5 μm. Average particle size can be determined using well known conventional techniques such as transmission electron microscopy (TEM), scanning electron microscopy (SEM), or using a particle size analyzer.

Some compositions of this invention can include one or more core-shell silver compounds as described above and one or more conventional non-photosensitive non-core-shell silver salts that are composed of one or more organic silver salts, especially conventional silver carboxylates and silver benzotriazoles, in any desirable proportions. These compositions can also include one or more binders (preferably polyvinyl butyral binders for organic coatings or latex binder dispersions for aqueous coatings), photosensitive silver halides, reducing agents, or any of these, as described herein, in conventional amounts.

In addition, conventional organic silver salts include the core-shell silver salts described in U.S. Pat. No. 6,355,408 (Whitcomb et al.), that is incorporated herein by reference. These silver salts include a core comprised of one or more silver salts and a shell having one or more different silver salts.

Still another useful source of conventional non-photosensitive reducible silver ions are the silver dimer compounds that comprise two different silver salts as described in U.S. Pat. No. 6,472,131 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

In another preferred embodiment, the non-photosensitive source of reducible silver ions used in the thermographic and photothermographic materials of this invention includes at least one of the non-core-shell silver compounds of this invention. These compounds have been prepared by mixing non-photosensitive silver halide grains with a salt comprising an organic silver coordinating ligand (such as a carboxylate or a triazolate). These compounds are silver salts of organic silver coordinating ligands. They are comparatively stable to light and provide reducible silver (1+) ions in thermal imaging reactions to form a silver image when heated to 50° C. or higher in the presence of an exposed photocatalyst (such as silver halide, when used in a photothermographic material) and a reducing agent composition.

Alternative compositions of this invention can include first and second core-shell silver compounds of this invention, wherein the silver compounds differ in their primary cores, shells, or both. These compositions can also include one or more binders (preferably polyvinyl butyral binders for organic coatings or latex binder dispersions for aqueous coatings), photosensitive silver halides, reducing agents, or any of these, as described herein, in conventional amounts.

The noted compositions can also include any of the conventional addenda described below that may be useful in thermally developable imaging emulsions and formulations, all in conventional amounts.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry photothermographic material, and preferably from about 0.01 to about 0.05 $mol/m^2$ of that material.

The total amount of silver (from all silver sources) in the thermographic and photothermographic materials is generally at least 0.002 $mol/m^2$ and preferably from about 0.01 to about 0.05 $mol/m^2$.

Preparation of Novel Silver Compounds

The novel core-shell silver compounds of this invention are prepared generally by mixing one or more core-shell-photosensitive silver halides (such as those described above) with one or more ammonium or alkali metal salts of organic silver coordinating ligands (as described above). Mixing is carried out for sufficient time, generally at least 5 to 10 minutes, at any suitable temperature (such as room temperature), for reaction of the organic silver coordinating ligand(s) with the outermost (shell) silver halide, forming at least a shell of one or more silver salts at least partially covering the rest of the photosensitive silver halide. Preferably, the silver salt shell completely covers the silver halide. The reaction can be carried out in water or in an organic solvent such as water-miscible alcohols. The reaction may also be carried out in water/organic solvent mixtures using organic solvents such as acetone, tetrahydrofuran, methyl ethyl ketone, alcohols (such as methanol or ethanol), or a tertiary alcohol (such as t-butanol).

This general method can be expressed by the following equation (I):

$$AgX^1(\text{core})/AgX^2(\text{shell})+M^+\text{ligand}^- \rightarrow AgX^1(\text{core})/\text{Ag-ligand}(\text{shell})+M^+(X^2)^- \quad (I)$$

wherein $X^1$ and $X^2$ represent different halides, $M^+$ represents a suitable ammonium or alkali metal cation (such as sodium or potassium), and ligand$^-$ represents an organic silver coordinating ligand. Multiple core-shell silver halides and ammonium or alkali metal-ligand salts can be used in this manner. Again, it should be noted that the primary core, $AgX^1$, may itself be comprised of inner and outer regions.

After sufficient reaction has been carried out, the resulting core-shell silver compound is isolated from the reaction mixture by conventional methods such as filtration, centrifugation, or ultrafiltration. Once isolated, the core-shell organic compounds of this invention can be mixed with other components and addenda to prepare emulsion or imaging formulations in any conventional manner.

It should be noted that by changing the ratio between the size of the silver halide core (for example, AgBr) and the silver halide shell (for example, AgCl) it is possible to obtain various ratios between the components of the photosensitive composition used photothermographic materials.

The reaction described in Equation (I) can also be used to provide intimate mixtures of photosensitive silver halide and organic silver salts by reacting mixed crystals containing a replaceable and a non-replaceable halide (such as silver chlorobromide) with an ammonium or alkali metal salt of an organic silver coordinating ligand (that is, $M^+$ Ligand$^-$) under the noted conditions.

This general method can be expressed by the following equation (II):

$$AgX^1 \cdot AgX^2+M^+\text{ ligand}^- \rightarrow AgX^1/\text{Ag-ligand}(\text{shell})+M^+(X^2)^- \quad (II)$$

wherein $X^1$, $X^2$, $M^+$, and ligand$^-$ are as described above.

The reaction described in Equation (I) can also be used to provide "fine" particles of organic silver salts (non-core-shell compounds) by reacting non-core-shell photosensitive silver halides (such as silver chloride or silver bromide) with an ammonium or alkali metal salt of an organic silver coordinating ligand (that is, $M^+$ Ligand$^-$) under the noted conditions. In this general method, the one or more organic silver coordinating ligands exchanges with anion $X^2$ of the silver halide converting the silver halide grain to Ag-ligand. Preferably, the one or more silver coordinating ligands completely exchanges with anion $X^2$ of the silver halide completely converting the silver halide grain to Ag-ligand. It is advantageous that this reaction is carried out in the absence of surfactants or surface modifiers that are traditionally used to keep very small silver salt particles in suspension. The resulting silver salts can have an average particle size of less than or equal to 1 $\mu$m, and preferably the average size is from about 0.1 to about 0.5 $\mu$m, as measured using well known conventional techniques. These "fine" silver salts can be incorporated into thermally developable imaging compositions that are free of surfactants or surface modifiers.

This general method can be expressed by the following Equation (III):

$$AgX^2+M^+\text{ ligand}^- \rightarrow \text{Ag-ligand}+M^+(X^2)^- \quad (III)$$

wherein $X^2$, $M^+$, and ligand$^-$ are as described above.

The preferred exchangeable anion, $X^2$ is chloride.

The present invention also provides novel core-shell silver compounds comprising a primary core comprising one or more non-photosensitive inorganic metal salts or non-silver-containing organic salts, and a shell at least partially covering the primary core, wherein the shell comprises one or more non-photosensitive silver salts, each of which silver salts comprises a organic silver coordinating ligand. These novel core-shell silver compounds may be prepared by mixing one or more core-shell silver salts with one or more ammonium or alkali metal salts of organic silver coordinating ligands as described above. In this embodiment, the core is made of a non-photosensitive inorganic metal salt or a non-silver-containing organic salt. Core-shell silver compounds of this type are particularly useful in thermographic materials.

This general method can be expressed by the following equation (IV):

$$\text{Metal}X^3(\text{core})/AgX^2(\text{shell})+M^+\text{ ligand}^- \rightarrow \text{Metal}X^3(\text{core})/\text{Ag-ligand}(\text{shell})+M^+(X^2)^- \quad (IV)$$

wherein Metal$X^3$ is a non-photosensitive inorganic metal salt or a non-silver-containing organic salt, and $X^2$, $M^+$, and ligand$^-$ are as described above. Again, $X^2$ is preferably chloride.

In one specific embodiment, the non-photosensitive inorganic metal salt is calcium fluoride. In another specific embodiment, the non-photosensitive inorganic metal salt is a non-photosensitive silver salt. In still another specific embodiment, the non-silver-containing salt is a non-silver salt of a long chain aliphatic carboxylate, a benzotriazole or a substituted derivative thereof, or a mixture of two or more of these. In a further specific embodiment, the Ag-ligand shell comprises a long chain aliphatic carboxylate, a benzotriazole a substituted derivative thereof, or a mixture of two or more of these.

Reducing Agents

The reducing agent (or reducing agent composition comprising two or more components) for the source of reducible silver ions can be any material, preferably an organic material, that can reduce silver (1+) ion to metallic silver. The reducing agent is often referred to as a developer or developing agent.

Conventional photographic developers can be used as reducing agents, including aromatic di- and tri-hydroxy compounds (such as hydroquinones, gallaic acid and gallic acid derivatives, catechols, and pyrogallols), aminophenols (for example, N-methylaminophenol), p-phenylenediamines, alkoxynaphthols (for example, 4-methoxy-1-naphthol), pyrazolidin-3-one type reducing agents (for example PENIDONE®), pyrazolin-5-ones, polyhydroxy spiro-bis-indanes, indan-1,3-dione derivatives, hydroxytetrone acids, hydroxy-tetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

When used with a silver benzotriazole silver source, ascorbic acid reducing agents are preferred. An "ascorbic acid" reducing agent means ascorbic acid, complexes, and derivatives thereof. Ascorbic acid developing agents are described in a considerable number of publications in photographic processes, including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792 A (Passarella et al.), EP 0 573 700 A (Lingier et al.), EP 0 588 408 A (Hieronymus et al.), U.S. Pat. No. 5,089,819 (Knapp), U.S. Pat. No. 5,278,035 (Knapp), U.S. Pat. No. 5,384,232 (Bishop et al.), U.S. Pat. No. 5,376,510 (Parker et al.), Japanese Kokai 7-56286 (Toyoda), U.S. Pat. No. 2,688,549 (James et al.), and *Research Disclosure*, item 37152, March 1995. D-, L-, or D,L-ascorbic acid (and alkali metal salts thereof) or isoascorbic acid (or alkali metal salts thereof) are preferred. Sodium ascorbate and sodium isoascorbate are most preferred. Mixtures of these developing agents can be used if desired.

When used with a silver carboxylate silver source within a photothermographic material, hindered phenolic reducing agents are preferred. In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Hindered phenol reducing agents are preferred (alone or in combination with one or more high-contrast co-developing agents and co-developer contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxy-biphenyls), bis(hydroxynaphthyl) methanes, bis(hydroxyphenyl)methanes (that is bisphenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetramethylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX® or PERMANAX WSO), 1,1'-bis(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX® 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

More specific alternative reducing agents that have been disclosed in dry silver systems including amidoximes such as phenylamidoxime, 2-thienyl-amidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenyl-acetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), and 3-pyrazolidones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.) and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,605 (Lynch et al.), incorporated herein by reference. Examples of these compounds include, but are not limited to, 2,5-dioxocyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancing agents can be used in some photothermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are reducing catechol-type reducing agents having no more than two hydroxy groups in an ortho-relationship. Preferred catechol-type reducing agents include, for example, catechol, 3-(3,4-dihydroxyphenyl)-propionic acid, 2,3-dihydroxy-benzoic acid, 2,3-dihydroxy-benzoic acid esters, 3,4-dihydroxy-benzoic acid, and 3,4-dihydroxy-benzoic acid esters.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, methyl 2,3-dihydroxy-benzoate, and ethyl 2,3-dihydroxy-benzoate.

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, methyl 3,4-dihydroxy-benzoate, ethyl 3,4-dihydroxy-benzoate, 3,4-dihydroxy-benzaldehyde, and phenyl-(3,4-dihydroxyphenyl)ketone. Such compounds are described, for example, in U.S. Pat. No. 5,582,953 (Uyttendaele et al.).

Still another particularly useful class of reducing agents are polyhydroxy spiro-bis-indane compounds described as photographic tanning agents in U.S. Pat. No. 3,440,049 (Moede). Examples include 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II).

Aromatic di- and tri-hydroxy reducing agents can also be used in combination with hindered phenol reducing agents either together or in combination with one or more high contrast co-developing agents and co-developer contrast-enhancing agents. These materials are described above.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color thermographic and photothermographic imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxy-phenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzlidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds includes those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbance are provided in U.S. Pat. No. 5,491,059 (noted above, Col. 14).

The total amount of one or more dye-forming or -releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The thermographic and photothermographic materials of this invention can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228 B1 (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenz-imidazole, 2-mercapto-5-methylbenzimidazole, 2-mercaptobenzothiazole and 2-mercaptobenzoxazole, and mixtures thereof If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury (2+) salts to the emulsion layer(s) as an antifoggant. Preferred mercury (2+) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in U.S. Pat. No. 6,143,487 (Philip, Jr. et al.), diisocyanate compounds as described, for example, in EP 0 600 586 A (Philip, Jr. et al.), and tribromomethylketones as described, for example, in EP 0 600 587 A (Oliff et al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants are polyhalo antifoggants, such as those having a —$SO_2C(X')_3$ group wherein X' represents the same or different halogen atoms.

Advantageously, the photothermographic materials of this invention also include one or more thermal solvents (or melt formers). Representative examples of such compounds include, but are not limited to, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, dimethylurea, D-sorbitol, and benzene-sulfonamide. Combinations of these compounds can also be used including a combination of succinimide and dimethylurea. Known thermal solvents are disclosed, for example, in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

It is often advantageous to include a base-release agent or base precursor in the photothermographic materials according to the invention to provide improved and more effective image development. A base-release agent or base precursor as employed herein is intended to include compounds which upon heating in the photothermographic material provide a more effective reaction between the described photosensitive silver halide, and the image-forming combination comprising a silver salt and the silver halide developing agent. Representative base-release agents or base precursors include guanidinium compounds, such as guanidinium trichloroacetate, and other compounds that are known to release a base moiety but do not adversely affect photographic silver halide materials, such as phenylsulfonyl acetates. Further details are provided in U.S. Pat. No. 4,123,274 (Knight et al.).

A range of concentration of the base-release agent or base precursor is useful in the described photothermographic materials. The optimum concentration of base-release agent or base precursor will depend upon such factors as the desired image, particular components in the photothermographic material, and processing conditions.

The use of "toners" or derivatives thereof that improve the image are highly desirable components of the thermographic and photothermographic materials of this invention. Toners are compounds that when added to the thermographic and photothermographic imaging layer shift the color of the developed silver image from yellowish-orange to brown-black or blue-black. Generally, one or more toners described herein are present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer.

Such compounds are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethylpyrazole), 1,8-(3,6-diazaoctane)bis(isothiuronium) trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidine-dione}, phthalazine and derivatives thereof [such as those described in U.S. Pat. No. 6,146,822

(Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (3+), rhodium bromide, rhodium nitrate, and potassium hexachlororhodate (3+)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H, 4H-2,3a,5,6a-tetraazapentalene and 1,4-di-(o-chlorophenyl)-3,6-dimercapto-1H, 4H-2,3a,5,6a-tetraazapentalene].

Phthalazines and phthalazine derivatives [such as those described in U.S. Pat. No. 6,146,822 (noted above), incorporated herein by reference], phthalazinone, and phthalazinone derivatives are particularly useful toners.

Additional useful toners are substituted and unsubstituted mercaptotriazoles as described for example in U.S. Pat. No. 3,832,186 (Masuda et al.), U.S. Pat. No. 6,165,704 (Miyake et al.), U.S. Pat. No 5,149,620 (Simpson et al.), U.S. Pat. No. 6,713,240 (Lynch et al.) and U.S. Ser. No. 10/192,944 (filed Jul. 11, 2002 by Lynch, Ulrich, and Zou, all of which are incorporated herein by reference.

The photothermographic materials of this invention can also include one or more image stabilizing compounds that are usually incorporated in a "backside" layer. Such compounds can include, but are not limited to, phthalazinone and its derivatives, pyridazine and its derivatives, benzoxazine and benzoxazine derivatives, benzothiazine dione and its derivatives, and quinazoline dione and its derivatives, particularly as described in copending U.S. Ser. No. 10/041,386 (filed Jan. 8, 2002 by Kong). Other useful backside image stabilizers include, but are not limited to, anthracene compounds, coumarin compounds, benzophenone compounds, benzotriazole compounds, naphthalic acid imide compounds, pyrazoline compounds, or compounds described for example, in copending U.S. Ser. No. 09/638,788 (filed Aug. 15, 2000 by Kong and Sakizadeh) and GB 1,565,043 (Fuji Photo). All of these patents and patent applications are incorporated herein by reference.

Binders

The photosensitive silver halide (when used), the non-photosensitive source of reducible silver ions (that is, the core-shell silver compounds), the reducing agent composition, and any other imaging layer additives used in the present invention are generally added to one or more binders that are either hydrophilic or hydrophobic. Thus, either aqueous or organic solvent-based formulations can be used to prepare the thermally developable materials of this invention. Mixtures of either or both types of binders can also be used. It is preferred that the binder be selected from hydrophobic polymeric materials such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and PIOLOFORM® BS-18 or PIOLOFORM® BL-16 (Wacker Chemical Company). Aqueous dispersions (or latexes) of hydrophobic binders such as those described in EP-0 911 691 A1 (Ishizaka et al.) may also be used.

Examples of useful hydrophilic binders include, but are not limited to, proteins and protein derivatives, gelatin and gelatin-like derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides (such as dextrans and starch ethers), and other synthetic or naturally occurring vehicles commonly known for use in aqueous-based photographic emulsions (see for example, *Research Disclosure*, item 38957, noted above). Cationic starches can be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described for example, in EP 0 600 586 B1 (Philip et al.), vinyl sulfone compounds as described in U.S. Pat. No. 6,143,487 (Philip et al.), and EP 0 460 589 (Gathmann et al.), aldehydes, and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y. 1977, Chapter 2, pp. 77–78.

Where the proportions and activities of the thermographic and photothermographic materials require a particular developing time and temperature, the binder(s) should be able to withstand those conditions. When a hydrophobic binder is used, it is preferred that the binder does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. The effective range of amount of polymer can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

It is particularly useful in the thermally developable materials of this invention to use predominantly (more than 50% by weight of total binder weight) hydrophobic binders in both imaging and non-imaging layers on both sides of the support. In particular, the antistatic compositions described in more detail below are formulated and disposed on the support with one or more hydrophobic binders such as cellulose ester binders. Of these binders, cellulose acetate, cellulose acetate butyrate, and cellulose acetate propionate are preferred. Cellulose acetate butyrate is more preferred as the predominant binder for the conductive antistatic layers. In most preferred embodiments, cellulose acetate butyrate is the only binder in the conductive antistatic layers.

Support Materials

The thermographic and photothermographic materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly preferred support. Various support materials are described, for example, in *Research Disclosure*, August 1979, item 18431. A method of making dimensionally stable polyester films is described in *Research Disclosure*, September 1999, item 42536.

It is also useful to use supports comprising dichroic mirror layers wherein the dichroic mirror layer reflects radiation at least having the predetermined range of wavelengths to the emulsion layer and transmits radiation having wavelengths outside the predetermined range of wavelengths. Such dichroic supports are described in U.S. Pat. No. 5,795,708 (Boutet), incorporated herein by reference.

It is further useful to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are described in WO 02/21208 A1 (Simpson et al.), incorporated herein by reference.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Photothermographic Formulations

An organic-based formulation for the thermographic and photothermographic emulsion layer(s) can be prepared by dissolving and dispersing the binder, the photocatalyst (when used), the source of non-photosensitive silver ions, the reducing composition, toner(s), and optional addenda in an organic solvent, such as toluene, 2-butanone (methyl ethyl ketone), acetone, or tetrahydrofuran.

Alternatively, the desired imaging components can be formulated with a hydrophilic binder (such as gelatin or a gelatin-derivative, or latex) in water or water-organic solvent mixtures to provide aqueous-based coating formulations.

Thermographic and photothermographic materials of the invention can contain plasticizers and lubricants such as poly(alcohols) and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-0 792 476 B1 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The thermographic and photothermographic materials of this invention can be constructed of one or more layers on a support. Single layer materials should contain the photocatalyst, the non-photosensitive source of reducible silver ions, the reducing composition, the binder, as well as optional materials such as toners, acutance dyes, coating aids and other adjuvants.

Two-layer constructions comprising a single imaging layer coating containing all the ingredients and a surface protective topcoat are generally found in the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in thermographic and photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), and U.S. Pat. No. 6,420,102 (Bauer et al.), all incorporated herein by reference.

Thermographic and photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405 (Ludemann et al.), incorporated herein by reference.

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different solvents (or solvent mixtures).

While the first and second layers can be coated on one side of the film support, manufacturing methods can also include forming on the opposing or backside of said polymeric support, one or more additional layers, including an antihalation layer, an antistatic layer, or a layer containing a matting agent (such as silica), or a combination of such layers.

It is also contemplated that the photothermographic materials of this invention can include emulsion layers on both sides of the support and at least one infrared radiation absorbing heat-bleachable compositions as an antihalation underlayer beneath at least one emulsion layer.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation coating on the support opposite to the side on which the emulsion and topcoat layers are coated.

Dyes useful as antihalation and acutance dyes include squaraine dyes described in U.S. Pat. No. 5,380,635 (Gomez et al.), U.S. Pat. No. 6,063,560 (Suzuki et al.), and EP 1 083 459 A1 (Kimura), the indolenine dyes described in EP 0342 810 A (Leichter), and the cyanine dyes described in U.S. Pat. No. 6,689,547 (Hunt et al.). All of the above are incorporated herein by reference.

It is also useful in the present invention to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), JP 2001-142175 (Hanyu et al.), and JP 2001-183770 (Hanye et al.). Also useful are bleaching compositions described in JP 11-302550 (Fujiwara), JP 2001-109101 (Adachi), JP 2001-51371 (Yabuki et al.), and JP 2000-029168 (Noro). All of the above are incorporated herein by reference.

Particularly useful heat-bleachable backside antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. 6,558,880 (Goswami et al.) and U.S. Pat. No. 6,514,677 (Ramsden et al.), both incorporated herein by reference.

Under practical conditions of use, the compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

In preferred embodiments, the photothermographic materials of this invention include a surface protective layer on the same side of the support as the one or more thermally-developable layers, an antihalation layer on the opposite side of the support, or both a surface protective layer and an antihalation layer on their respective sides of the support.

Antistatic Compositions/Layers

The thermally developable materials of this invention generally include one or more antistatic or conducting layers. Such layers may contain conventional antistatic agents known in the art for this purpose such as soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), electrically-conductive metal-containing particles dispersed in a polymeric binder such as those described in EP 0 678 776 A (Melpolder et al.), and the solutions and dispersions of polythiophene compounds described in U.S. Pat. No. 5,300,575 (Jonas et al.)

Other antistatic compositions include one or more fluorochemicals each of which is a reaction product of $R_f$—$CH_2CH_2$—$SO_3H$ with an amine wherein $R_f$ comprises 4 or more fully fluorinated carbon atoms. These antistatic compositions are described in more detail in U.S. Pat. No. 6,699,648 (Sakizadeh et al.) that is incorporated herein by reference.

Imaging/Development

The thermally developable materials of the present invention can be imaged in any suitable manner consistent with the type of material using any suitable imaging source (typically some type of radiation or electronic signal for photothermographic materials and a source of thermal energy for thermographic materials). In some embodiments, the materials are sensitive to radiation in the range of from about at least 300 nm to about 1400 nm, and preferably from about 300 nm to about 850 nm.

Imaging can be achieved by exposing the photothermographic materials of this invention to a suitable source of radiation to which they are sensitive, including ultraviolet radiation, visible light, near infrared radiation and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

When imaging thermographic materials of this invention, the image may be "written" simultaneously with development at a suitable temperature using a thermal stylus, a thermal print head, or a laser, or by heating while in contact with a heat-absorbing material. The thermographic materials may include a dye (such as an IR-absorbing dye) to facilitate direct development by exposure to laser radiation. The dye converts absorbed radiation to heat.

Use as a Photomask

The thermographic and photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials and subsequent development affords a visible image. The heat-developed thermographic and photothermographic materials absorbs ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

The present invention also provides a method for the formation of a visible image (usually a black-and-white image) by first exposing to electromagnetic radiation and thereafter heating the inventive photothermographic material. In one embodiment, the present invention provides a method comprising:

A) imagewise exposing the photothermographic material of this invention to electromagnetic radiation to which the photocatalyst (for example, a photosensitive silver halide) of the material is sensitive, to form a latent image, and B) simultaneously or sequentially, heating the exposed material to develop the latent image into a visible image.

The photothermographic material may be exposed in step A using any source of radiation, to which it is sensitive, including: ultraviolet radiation, visible light, infrared radiation or any other infrared radiation source readily apparent to one skilled in the art.

The present invention also provides a method for the formation of a visible image (usually a black-and-white image) by thermal imaging of the inventive thermographic material. In one embodiment, the present invention provides a method comprising:

A) thermal imaging of the thermographic material of this invention to form a visible image.

This visible image prepared from either a thermographic or photothermographic material can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the heat-developed thermographic or photothermographic material. Thus, in some other embodiments wherein the thermographic or photothermographic material comprises a transparent support, the image-forming method further comprises:

C) positioning the exposed and heat-developed thermographic or photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

Materials and Methods for the Examples

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID™ A-21 or PARALOID™ A-21 is an acrylic copolymer available from Rohm and Haas (Philadelphia, Pa.).

CAB 171-15S is a cellulose acetate butyrate resin available from Eastman Chemical Co (Kingsport, Tenn.).

DESMODUR™ N3300 is an aliphatic hexamethylene diisocyanate available from Bayer Chemicals (Pittsburgh, Pa.).

LOWINOX™ 221B446 is 2,2'-isobutylidene-bis(4,6-dimethylphenol) available from Great Lakes Chemical (West Lafayette, Ind.).

PIOLOFORM™ BL-16 and BS-18 are a polyvinyl butyral resins available from Wacker Polymer Systems (Adrian, Mich.).

MEK is methyl ethyl ketone (or 2-butanone).

Sensitizing Dye A has the structure shown below.

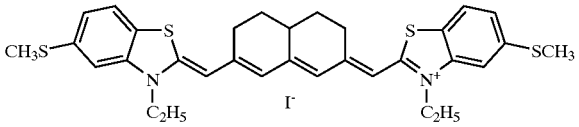

Vinyl Sulfone-1 (VS-1) is described in U.S. Pat. No. 6,143,487 and has the structure shown below.

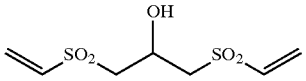

Antifoggant A is 2-(tribromomethylsulfonyl)quinoline and has the structure shown below.

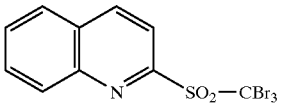

Antifoggant B is ethyl-2-cyano-3-oxobutanoate. It is described in U.S. Pat. No. 5,686,228 and has the structure shown below.

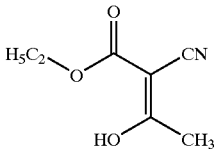

Antihalation Dye A is cyclobutenediylium, 1,3-bis[2,3-dihydro-2,2-bis [[1-oxohexyl)oxy]methyl]-1H-perimidin-4-yl]-2,4-dihydroxy-, bis(inner salt) and has the structure shown below.

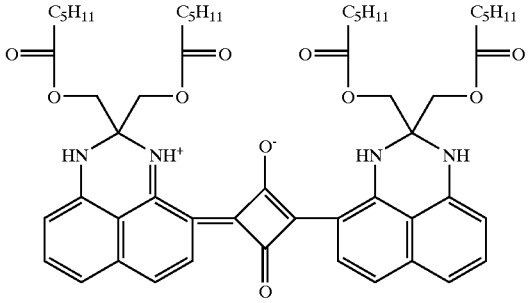

Preparation of Core-Shell Silver Compounds

Preparation of Core-Shell Silver Halide Grains with a Silver Chloride Shell

The following describes the preparation of core-shell silver halide grains having an inner region of silver bromoiodide, an outer region of silver bromide, and a shell of silver chloride.

Photosensitive iridium-doped silver halide grains having an inner region of silver bromoiodide and an outer region of silver bromide were prepared substantially as described in U.S. Pat. No. 5,939,249 (Zou).

A reaction vessel equipped with a stirrer was charged with 75 g of phthalated gelatin, 1650 g of deionized water, an antifoamant, 0.5 mol of photosensitive iridium-doped, silver halide grains prepared above and sufficient nitric acid to adjust pH to 5.0, at 36° C. A silver/silver bromide electrode was attached. Solution A and Solution B were added simultaneously while vAg was held constant at 25 mV throughout the addition. The temperature of the re actor was also held constant at 36° C. throughout the addition.

Solution A was prepared at 25° C. as follows:

| | |
|---|---|
| $AgNO_3$ | 454 g |
| Deionized water | 1460 g |

Solution B was prepared at 25° C. as follows:

| | |
|---|---|
| KCl | 223.5 g |
| $K_2IrCl_6$ | 0.0025 g |
| Deionized Water | 1636 g |

The addition rates of solution A and solution B started at 32 ml/min, then accelerated as a function of total reaction time according to the equation:

Flow Rate=$32(1+0.003t^2)$ ml/min, where t is the time in minutes.

The reaction was terminated after 28.5 minutes when all Solution A was consumed. The emulsion was coagulation washed and the pH was adjusted to 5.5 to give 4.3 mol of core-shell silver halide grains CS-1. The average grain size was 0.25 $\mu$m as determined by Scanning Electron Microscopy (SEM).

Preparation of Core-Shell Silver Halide Grains with a Silver Chlorobromide Shell Core-shell silver halide grains having an inner region of silver bromoiodide, an outer region of silver bromide, and a shell of silver chlorobromide were prepared in manner identical to that described above but using the a Solution B comprising potassium chloride and potassium bromide.

Solution B was prepared at 25° C. as follows:

| | |
|---|---|
| KCl | 59.23 g |
| KBr | 378.4 g |
| $K_2IrCl_6$ | 0.0025 g |
| Deionized Water | 1636 g |

Core-shell silver halide grains CS-2 were obtained.

Preparation of Photothermographic Emulsion

Photothermographic emulsions (EM-1 and EM-2) were prepared using core-shell silver halide grains (CS-1 and CS-2) prepared as described above. A control photothermographic emulsion (EM-C) was prepared directly from the photosensitive iridium-doped silver halide grains having an inner region of silver bromoiodide and an outer region of silver bromide.

Preparation of Photosensitive Silver Soap Dispersion

A photosensitive silver soap dispersion was prepared as described below. This composition is also sometimes known as a "silver soap emulsion," "preformed soap," or "homogenate." Exchange of chloride in the shell for carboxylate occurs during this step.

I. Ingredients

1. Silver halide emulsion (0.60 mole) at 700 g/mole in 1.25 liters of water at 40° C.
2. 88.5 g of sodium hydroxide in 1.50 liter of water.
3. 370 g of silver nitrate in 2.5 liters of water.
4. 118 g of Humko Type 9718 fatty acid (available from Witco. Co., Memphis, Tenn.).
5. 570 g of Humko Type 9022 fatty acid (available from Witco. Co., Memphis, Tenn.).
6. 19 ml of concentrated nitric acid in 50 ml of water.

II. Reaction

1. Ingredients #4 and #5 were dissolved at 80° C. in 12 liters of water and mixed for 15 minutes.
2. Ingredient #2 was added to the Step 1 solution at 80° C. and mixed for 5 minutes to form a dispersion.
3. Ingredient #6 was added to the dispersion at 80° C. while cooling the dispersion to 55° C. and stirring for 20 minutes.
4. Ingredient #1 was added to the dispersion at 55° C. and mixed for the amount of time indicated:

| Sample | Emulsion | Core-Shell Compound | Step #4 Time (min) |
|---|---|---|---|
| 1-1 | EM-1 | CS-1 | 10 |
| 1-2 | EM-2 | CS-1 | 20 |
| 1-3 | EM-3 | CS-2 | 10 |
| 1-3 | EM-4 | CS-2 | 20 |
| 1-Control | EM-C | — | 5 |

5. Ingredient #3 was added to the dispersion at 55° C. and mixed for 10 minutes.
6. The dispersion was centrifuged washed until the wash water had a resistivity of 20,000 ohm/cm$^2$.
7. The dispersion was dried at 45° C. for 72 hours.

III. Homogenization

A photothermographic emulsion was prepared by homogenizing the pre-formed soaps prepared above in organic solvent and BUTVAR® B-79 poly(vinyl butyral) according to the following procedure 1. 440 g of pre-formed soap were added to 1530 g of 2-butanone and 30 g of BUTVAR® B-79.
2. The dispersion was mixed for 5 minutes and held for 4 hours at room temperature.
3. The dispersion was homogenized twice at 5000 psi ($3.45\times10^4$ kPa).

EXAMPLE 1

Preparation of Photothermographic Materials

Each of the photothermographic emulsions prepared above was homogenized to 28.1% solids in MEK containing Pioloform BS-18 polyvinyl butyral binder (4.4% solids). To 192 parts of this emulsion were added 1.6 parts of a 15% solution of pyridinium hydrobromide perbromide in methanol with stirring. After 60 minutes of mixing, 2.1 parts of an 11% zinc bromide solution in methanol was added. Stirring was continued and after 30 minutes, an addition to was made of a solution of 0.15 parts 2-mercapto-5-methylbenzimidazole, 0.007 parts Sensitizing Dye A, 1.7 parts of 2-(4-chlorobenzoyl)benzoic acid, 10.8 parts of methanol, and 3.8 parts of MEK.

After stirring for another 75 minutes, 41 parts of Pioloform BL-16 was added, the temperature was reduced to 10° C., and mixing was continued for another 15 minutes.

At this time, the photothermographic imaging formulation was completed by adding to it Solution A, LOWINO™, Solution B, and Solution C. These materials were added 5 minutes apart. Mixing was maintained.

| Solution A: | |
|---|---|
| Antifoggant A | 1.3 parts |
| Tetrachlorophthalic acid | 0.37 parts |
| 4-Methylphthalic acid | 0.60 parts |
| MEK | 20.6 parts |
| Methanol | 0.36 parts |
| LOWINOX ™ 221B446 | 9.5 parts |

| Solution B: | |
|---|---|
| DESMODUR ™ N3300 | 0.66 parts |
| MEK | 0.33 parts |

| Solution C: | |
|---|---|
| Phthalazine | 1.3 parts |
| MEK | 6.3 parts |

A topcoat formulation for the photothermographic emulsion layer was prepared as follows:

| Topcoat Formulation: | |
|---|---|
| ACRYLOID A-21 | 0.25 parts |
| CAB 171-15S | 6.56 parts |
| Vinyl sulfone (VS-1) | 0.25 parts |
| Benzotriazole | 0.14 parts |
| Antifoggant B | 0.13 parts |
| Antihalation Dye A | 0.11 parts |
| MEK | 92.44 parts |

The imaging (silver) and topcoat formulations were simultaneously dual knife coated onto a 178 $\mu$m polyethylene terephthalate support to provide photothermographic materials with the topcoat being farthest from the support. The web (support and applied layers) was conveyed at a rate of 5 meters per minute during coating and drying. Simultaneous coating allowed the radiation-absorbing compound in the topcoat formulation to diffuse down into the imaging layer formulation before drying. Immediately after coating, the samples were dried in an oven at about 85° C. for 5 minutes. The imaging layer formulation was coated to provide about 2 g of silver/m$^2$ dry coating weight. The topcoat formulation was coated to provide about 2.6 g/m$^2$ dry coating weight.

Sensitometry measurements were made on a custom-built computer scanned densitometer and are believed to be comparable to measurements from commercially available densitometers. The coated and dried photothermographic materials prepared above were cut into 1.5 inch×10 inch strips (3.6 cm×25.4 cm) and exposed through a 10 cm continuous wedge with a scanning laser sensitometer incorporating an 811 nm laser diode. The total scan time for the sample was 6 seconds. The samples were developed using a heated roll processor for 15 seconds at 252° F. (122.2° C.).

The photospeed of indicated samples was compared to the speed (set at "100") of a control film as described in that example. Speed-2 (Spd-2) is the relative photospeed of a sample at the density value of 1.00 above $D_{min}$. The results, shown below in TABLE I, demonstrate that core-shell silver compounds prepared by exchange of halide from the silver halide shell to form a non-photosensitive silver salt shell covering a photosensitive silver halide core, provide photothermographic materials with imaging properties approaching those of conventionally prepared photothermographic materials.

TABLE I

| Sample | Emulsion | $D_{min}$ | $D_{max}$ | Relative Spd-2 |
|---|---|---|---|---|
| 1-1 | EM-1 | 0.343 | 2.46 | 34 |
| 1-2 | EM-2 | 0.345 | 2.42 | 32 |
| 1-3 | EM-3 | 0.363 | 2.83 | 54 |
| 1-4 | EM-4 | 0.364 | 2.64 | 49 |
| 1-C | EM-C | 0.211 | 3.73 | 100 |

EXAMPLE 2

Demonstration of Thermographic Development

The following experiment was carried out in a darkroom under green safelight. Samples prepared above were placed on a thermal wedge (Reichert Hot Bench™) for 15 seconds and immediately thermally quenched on a heat sink (at room temperature). The temperatures for the onset of thermal imaging ($T_{onset}$) were measured. The results, shown below in TABLE II demonstrate that core-shell silver compounds prepared by exchange of halide from the silver halide shell to form a non-photosensitive silver salt shell covering a photosensitive silver halide core, provided thermographic materials with imaging properties approaching those of conventional thermographic materials.

TABLE II

| Sample | $T_{onset}$ |
|---|---|
| 1-1 | 155° C. |
| 1-2 | 176° C. |
| 1-3 | 162° C. |
| 1-4 | 177° C. |

It is also believed that silver compounds prepared by exchange of halide from a homogeneous (non-core-shell) silver halide to form a non-photosensitive silver salt would also provide thermographic materials with acceptable imaging properties.

EXAMPLE 3

Preparation Reactions According to Reaction (I)

Three different silver halide (AgX) emulsions were used to prepare the silver carboxylates according to reactions (I) and (II) above:

TABLE III

| Sample | Core | Shell | Grain Size (nm) |
|---|---|---|---|
| 3-1 | 25% (92% AgBr, 8%/AgI) | 75% (100% AgBr) | 68–70 |
| 3-2 | 25% (92% AgBr, 8%/AgI) | 75% (100% AgCl) | 68–70 |
| 3-3 | 10% (100% AgBr) | 90% (100% AgCl) | 68–70 |

In samples 3-2 and 3-3, a shell of silver stearate was formed by replacement of the silver chloride shell. The X-ray diffraction results were consistent with the exchange reaction in equation (I). In sample 3-1, no exchange was seen.

It is believed that the AgBr(I)/AgStearate interface would favor the growth of dendritic silver crystals ($Ag^0$) during thermographic and photothermographic development. Dendritic silver crystals are preferred as they provide higher covering power in thermographic and photothermographic constructions.

EXAMPLE 4

Preparation Reactions According to Reaction (III)

An aqueous gelatin dispersion of cubic silver chloride grains was reacted with a 0.1M solution of sodium stearate at 60° C. The ratio of sodium stearate to silver chloride was 1:1. During the reaction, aliquots were removed for analysis by transmission electron microscopy (TEM). After approximately 30 minutes, the presence of silver stearate on the surface of the silver chloride crystals was readily apparent. After approximately 24 hours, complete conversion to silver stearate was observed.

The exchange reaction between the chloride of the silver chloride shell and stearate was confirmed by X-ray diffraction and transmission electron microscopy (TEM). Again, X-ray diffraction results were consistent with the exchange reaction in equation (III). The TEM results also showed that the core-shell silver halide/silver carboxylate interface was significantly different from that of known in-situ or preformed soaps.

The invention has been described in detail with particular reference to certain preferred embodiments thereof, but it will be understood that variations and modifications can be effected within the spirit and scope of the invention.

We claim:

1. A photothermographic material comprising a support having thereon one or more layers comprising:

a) a source of non-photosensitive silver ions comprising a core-shell silver compound comprising a primary core comprising one or more photosensitive silver halides, and a shell covering said primary core, wherein said shell comprises one or more non-photosensitive silver salts, each of which silver salts comprises an organic silver coordinating ligand, b) a reducing composition for said non-photosensitive silver ions, c) a binder, and d) a photocatalyst.

2. The photothermographic material of claim 1 wherein said photocatalyst includes one or more silver halides, and said binder is a hydrophilic binder.

3. The photothermographic material of claim 2 wherein said photocatalyst comprises core-shell silver halide grains.

4. The photothermographic material of claim 1 wherein said photocatalyst includes one or more silver halides, and said binder is a hydrophobic binder.

5. The photothermographic material of claim 1 wherein said organic silver coordinating ligand is a benzotriazole or a substituted derivative thereof, a long chain aliphatic carboxylate, or a mixture or two or more of these.

6. The photothermographic material of claim 5 wherein said organic silver coordinating ligand is a benzotriazole or a substituted derivative thereof, behenate, stearate, or a mixture or two or more of these.

7. The photothermographic material of claim 1 that provides a color image and wherein said reducing composition comprises a dye-forming or -releasing compound.

8. A method comprising:

A) imagewise exposing the photothermographic material of claim 1 to electromagnetic radiation to form a latent image, and B) simultaneously or sequentially, heating the exposed material to develop the latent image into a visible image.

9. The photothermographic material of claim 1 wherein the molar ratio of said one or more non-photosensitive silver salts in said shell to said one or more silver halides in said primary core of said core-shell silver compound is from about 100:1 to about 1:100.

10. The photothermographic material of claim 1 wherein said primary core of said core-shell silver compound contains predominantly silver bromide.

11. The photothermographic material of claim 1 wherein said primary core of said core-shell silver compound contains silver chlorobromide, silver iodobromide, or silver bromide.

12. The photothermographic material of claim 1 wherein said shell of said core-shell silver compound comprises a mixture of silver salts comprising different organic silver coordinating ligands.

13. The photothermographic material of claim 12 wherein said shell of said core-shell silver compound comprises a silver carboxylate as one of said silver salts.

14. The photothermographic material of claim 13 wherein said shell of said core-shell silver compound comprises a silver long chain aliphatic carboxylate as one of said silver salts.

15. The photothermographic material of claim 1 wherein said core-shell silver compound has an average particle size of from about 50 nm to about 10 $\mu$m.

16. The photothermographic material of claim 1 where said primary core of said core-shell silver compound is composed of an inner region comprising a first silver halide and an outer region comprising a different silver halide.

17. The photothermographic material of claim 16 wherein said inner region of said core-shell silver compound is composed predominantly of a mixture of silver bromide and silver iodide, and said outer region is composed of predominantly silver bromide.

18. The photothermographic material of claim 1 wherein said organic silver coordinating ligand contains imino groups.

19. The photothermographic material of claim 18 wherein said organic silver coordinating ligand is a benzotriazole or substituted derivative thereof, a 1,2,4-triazole, a 1-H-tetrazole, or an imidazole derivative.

* * * * *